United States Patent [19]

Walker

[11] Patent Number: 4,708,203

[45] Date of Patent: Nov. 24, 1987

[54] COMPOSITE DRILL COLLAR

[75] Inventor: John H. Walker, Bartlesville, Okla.

[73] Assignee: Phillips Petroleum Company, Bartlesville, Okla.

[21] Appl. No.: 868,409

[22] Filed: May 29, 1986

[51] Int. Cl.[4] ..... F16L 57/00

[52] U.S. Cl. ..... 166/241; 175/325

[58] Field of Search ..... 138/96 R, 103, 108, 138/110, 114, 178; 16/2, 108, 109; 166/241, 380; 175/57, 61, 65; 384/35, 911; 428/36; 175/325

[56] References Cited

U.S. PATENT DOCUMENTS

| | | | |
|---|---|---|---|
| 2,153,787 | 4/1939 | Anderson | 138/112 X |
| 3,197,556 | 7/1965 | Simon | 16/2 X |
| 3,942,824 | 3/1976 | Sable | 285/45 |
| 4,343,518 | 8/1982 | Povrchot | 175/365 |
| 4,544,701 | 10/1985 | Walker | 524/609 |
| 4,653,598 | 3/1987 | Schuh et al. | 175/325 X |

*Primary Examiner*—Henry J. Recla
*Assistant Examiner*—Mark J. Thronson
*Attorney, Agent, or Firm*—Williams, Phillips & Umphlett

[57] ABSTRACT

A drill collar is formed from a composite material to protect equipment during drilling operations as in oil and gas exploration.

8 Claims, 2 Drawing Figures

COMPOSITE DRILL COLLAR

BACKGROUND OF THE INVENTION

In one aspect, the invention relates to a collar device. In another aspect, the invention relates to the use of a collar device to protect a drill pipe during drilling operations. In yet another aspect, the invention relates to a method for forming a composite drill collar device from a reinforced plastic.

In the drilling of wells, for example, oil wells, a hollow drill pipe string positioned in a drill pipe casing is often used. A bit is positioned on the end of the drill pipe string. Mud flows down the hollow drill pipe string, past the bit, and up the annulus between the drill pipe string and the drill pipe casing to carry away cuttings produced by the bit. In the absence of collar devices positioned on the drill pipe string, dragging of the drill pipe string on the inside of the casing during the drilling process can result in damage to either or both of the drill pipe string or the drill pipe casing. Collar devices can be fitted to either/or both of the drill pipe string or casing to mitigate such damage. Since the collar devices can become damaged, it is desirable that they be attached to the drill pipe string to facilitate their removal and replacement if required. It is often not feasible to form the collars from highly damage-resistant materials such as steel because in such case the collar itself would be capable of damaging the drill pipe string or drill pipe casing. To massively construct the collar to resist damage is often not feasible because large sizing would impede the flow of mud up the annulus and interfere with the drilling of the well. Thermoset materials are not entirely suitable because of their brittleness. Common thermoplastic materials are not suitable in many applications because of their softness and low temperature resistance.

OBJECTS OF THE INVENTION

It is an object of this invention to provide a collar device especially well adapted for use in the drilling of oil and gas wells.

It is a further object of this invention to provide a method for protecting a drill pipe string and a drill pipe casing from damage by the other by use of a unique collar for a drill pipe string.

It is yet another object of this invention to provide a method for constructing a composite collar for a drill pipe which is highly resistant to downhole conditions.

SUMMARY OF THE INVENTION

In one embodiment of the invention, there is provided a collar which is especially well adapted for use on a drill pipe string. The collar has a generally tubular configuration and has a radially varying wall thickness. When the wall thickness is made to vary in the hereinafter described manner the collar is resistant to turning with the drill pipe string in the drill pipe casing. The collar has a first end, a second end, and a longitudinal axis extending between the first end and the second end. It also has an inner surface and an outer surface. The inner surface is characterized by a generally radially inwardly extending flange or rib at a position adjacent the first end of the collar. The flange or rib is especially well adapted for receipt by a groove on the drill pipe string. A generally cylindrical inside surface portion extends between the flange portion and the second end of the drill collar. The outside surface of the collar is characterized by a portion of noncylindrical shape. This portion of noncylindrical shape has a first cross-sectional dimension measured through the longitudinal axis of the collar and a second cross-sectional dimension which is measured through the longitudinal axis of the collar of less than the first cross-sectional dimension. A collar constructed in this manner is well adapted to resist rotation with the drill pipe during side loading of the string.

In another embodiment of the present invention, there is provided a method for protecting a drill pipe string and a drill pipe casing from damage by the other. Generally, drill pipe strings are comprised of sections of drill pipe positioned within the drill pipe casing. Each section of the drill pipe has an upper end, generally bearing internal threads, and a lower end, generally bearing external threads. Both the upper end and the lower end of each drill pipe section are usually beveled where they join so that an annular groove is formed when two sections of drill pipe are joined together. The method of this embodiment of the invention comprises positioning the collar on the upper end of a section of drill pipe. The collar has an upper end, a lower end, an outside surface, and an inside surface. The inside surface at the upper end of the collar has a generally radially inwardly extending flange for loose receipt by the annular groove formed by the joining of the two drill pipe sections. The inside surface of the collar apart from the annular flange has a diameter sufficient to provide clearance between the inside of the collar and the outside of the drill pipe section so that the drill pipe section is free to rotate within the collar. The outside surface of the collar is sized with respect to the drill pipe casing so that clearance is provided between the outside of the collar and the inside of the drill pipe casing sufficient to provide a flow path for the drilling fluid. The collar has a varying wall thickness in the radial direction so as to resist spinning with the drill pipe string in the drill casing under conditions of side loading. Once the collar is positioned, the lower end of a drill pipe section is joined to the upper end of the drill pipe section having the collar positioned thereon and the joined drill pipe sections are lowered into the drill pipe casing. Where the collar is formed from a material which is softer than either the drill pipe string or the drill pipe casing and is more slippery than the casing with respect to the drill pipe and more slippery than the pipe with respect to the casing, the integrity of both the drill pipe string and the drill pipe casing can be preserved under adverse conditions.

In still another embodiment of the present invention, there is provided a method for forming a collar especially well suited for use on a drill pipe string. A roll of deformable material in the form of at least one thermoplastic sheet containing long fiber reinforcement is provided. The roll has a longitudinal axis around which the sheet is rolled. The roll is placed in an open mold having a longitudinal axis so that the longitudinal axis of the roll is approximately coaxial with the longitudinal axis of the mold. A mold core having a longitudinal axis coaxial with the roll's longitudinal axis is then inserted into the mold with force sufficient to close the mold and deform the material to fill a mold cavity as defined between the mold core and the mold when the mold is in the closed position. The mold cavity has a shape which at least partially determines the inner and outer surfaces of a collar precursor. The thus formed collar precursor is then cooled, the mold is opened, and the collar precursor is removed from the mold. Suitable end surfaces are then formed onto the collar precursor in a machining operation to form the finished collar according to the invention.

DETAILED DESCRIPTION OF THE INVENTION

Figure 1:
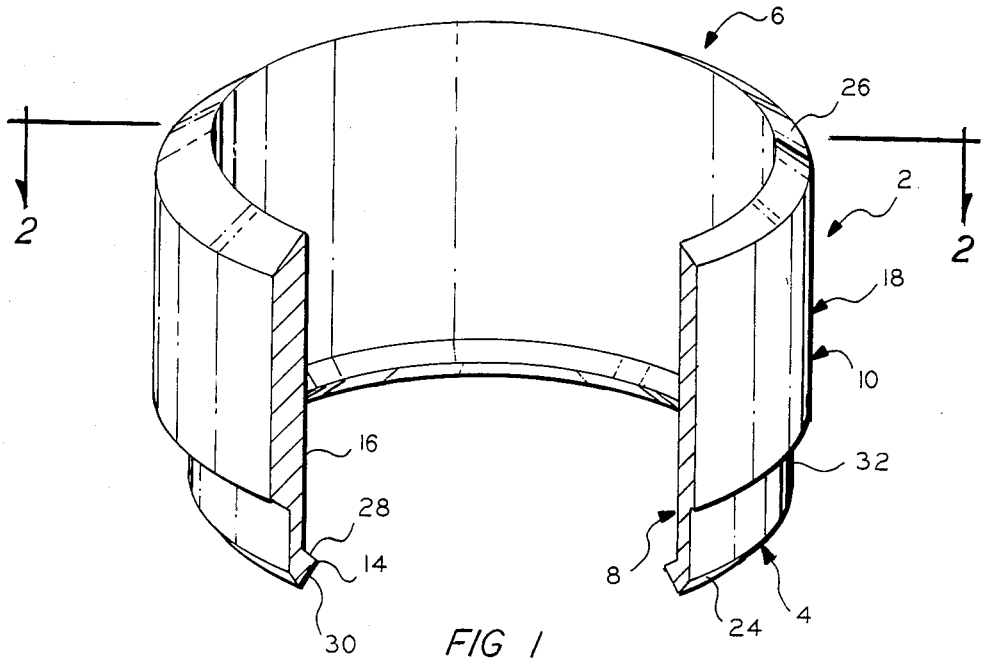
FIG. 1 is a pictorial representation of a collar embodying certain features of the present invention and having a section thereof removed to provide a clearer understanding of the invention.

According to the invention, there is provided a collar 2. The collar 2 has a first end 4, a second end 6, an inside surface 8 and an outside surface 10. The collar also has a longitudinal axis 12 as called out in FIG. 2 which would be normal to the plane of the paper in the illustrated embodiment.

Figure 2:
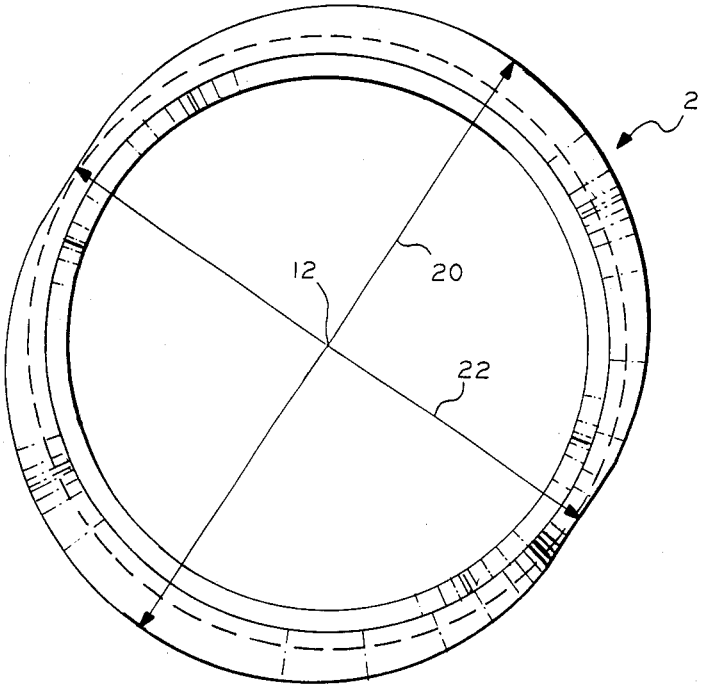
FIG. 2 is a plan view of an intact device of FIG. 1 as would appear when viewed along lines 2—2.

The inside surface 8 is characterized by a rib or generally inwardly extending flange 14 adjacent the first end 4 of the collar. A generally cylindrical portion 16 of the inside surface 8 extends between the flange portion 14 and the second end 6. The outside surface 10 of the collar is characterized by a portion 18 of generally noncylindrical shape. The portion 18 has a first cross-sectional dimension called out by reference numeral 20 in FIG. 2 as measured through the longitudinal axis 12 of the collar and a second cross-sectional dimension called out by the reference numeral 22 which is measured through the longitudinal axis 12 of the collar 2 and is less than the first cross-sectional dimension 20. Preferably, the dimension 20 measures the maximum cross-section dimension of the noncylindrical portion 18 of the collar 2 and the dimension 22 measures the minimum cross-section of the noncylindrical portion 18 of the collar 2. Where the portion 18 of the outside surface is of oval or elliptical cross-section, the dimension 20 can be described as the major axis and the dimension 22 as the minor axis of the ellipse or oval. Preferably, the portion 18 is of oval cross-section since a suitable mold of this configuration is easy to provide. As best seen in FIG. 2, the collar 2 is of varying wall thickness through the portion of noncylindrical shape. It is believed that under conditions of side loading, the drill pipe will settle into a position away from the thick sections of the collar wall. In this manner, rotation of the collar with the drill pipe can be avoided.

To facilitate raising and lowering the collar into a borehole such as in a drill pipe casing it is preferred that the collar be provided with a bevel 24 on its exterior surface at its first end 4 and bevel 26 positioned at the second end 6 on the outside surface 10 of the collar.

The flange or rib 14 is preferably generally annularly shaped since this shape is well adapted to be received by a groove on the drill pipe string and retain the collar in position. It is also simple and easy to form a generally annularly shaped flange in a machining operation. Preferably, the flange 14 exhibits a "V-shaped" cross-section, with a first face 28 of the V facing the second end 6 of the collar 2 and a second face 30 of the V facing the first end 4 of the collar 2.

In one embodiment of the invention, the outside surface 10 of the collar is divided into the noncylindrical portion 18 and a generally cylindrical portion 32 which is positioned between the noncylindrical portion 18 and the first end 4. The generally cylindrical portion 32 of the outside surface 18 facilitates positioning the collar for finishing the second end 6 in a machining operation. Dimensionally, the collar 2 can be of any desired size. Usually, its dimensions will be dictated by the dimensions of the drill pipe and drill pipe casing with which it is to be used. Generally, the maximum cross-sectional dimension of the collar 2 in a plane normal to the longitudinal axis of the collar ("diameter") will be from 50 percent to about 95 percent of the minimum inside diameter of the drill pipe casing. The minimum outside "diameter" of the collar 2 will usually range from about 75 to about 95 percent of the maximum outside "diameter" of the collar. Usually, the minimum outside "diameter" of the collar will be from about 85 to about 95 percent of the maximum outside "diameter" of the collar. The inside diameter of the collar 2 will typically range from about 102 percent to about 125 percent of the outside diameter of the drill pipe on which the collar is positioned. Usually, the inside diameter of the collar will be from about 102 percent to about 110 percent of the outside diameter of the drill pipe. The flange 14 will generally protrude radially inwardly from the generally cylindrical surface 16 a distance generally in the range of from about 0.02 to about 0.2 times the inside diameter of the collar across the generally cylindrical portion 16. Usually, the flange 14 will protrude inwardly a distance in the range of from about 0.05 to about 0.15 times the inside diameter of the collar 2 across the generally cylindrical inside surface 16. The collar 2 can have any desired length. Usually, its length as measured between the first end 4 and the second end 6 will range from about 0.2 to about two times the inside diameter of the collar 2 across the generally cylindrical surface 16 to provide sufficient bearing surface with good economy of materials.

When the outside surface is divided into a generally cylindrical portion and a noncylindrical portion the generally cylindrical portion will generally have a length sufficient to facilitate mounting the collar in a lathe chuck. Generally, the length will be in the range from about ¼-inch to about 2 inches, or in the range from about 0.1 to about 0.5 times the length of the collar as measured between the first end 4 and the second end 6.

The bevels 24 and 26 can form any desired angle with respect to the longitudinal axis 12 of the collar. Usually, the angle formed between the beveled surfaces 24 and 26 and the longitudinal axis will be in the range of from about 20° to about 60°. The angle of the "V" when the generally radially inwardly extending flange is of V-shaped cross-section will usually range from about 30° to about 120° between the surfaces 28 and 30, preferably between about 70° and 110°.

The collar of the invention is preferably formed from a polymer of a poly(arylene sulfide). The preferred poly(arylene sulfide) comprises a poly(phenylene sulfide), which term includes homopolymers, copolymers, terpolymers and the like which have a melting or softening temperature of at least about 300° F. Because of the high temperatures which can be encountered during drilling operations, the preferred poly(phenylene sulfide) has a melting or softening point in the range of from about 400° to about 900° F. For processing purposes, it is preferred that the poly(arylene sulfide) used in forming the collar have a melt flow in the range of from about 1 to about 500 g/10 min, preferably in the range of from about 25 to about 250 g/10 min. The melt flow of poly(phenylene sulfide) can be regulated by incorporated a small amount of trichlorobenzene comonomer into the polymerization reactor or by "curing" the polymer by air exposure at elevated temperature.

Suitable reinforcing fibers can be selected from the group consisting of glass, carbon, aramid and metals, if desired, although glass if preferred because it is economical and provides good properties in the final product. Preferably, the collar material is introduced into the mold in the form of one or more prepreg sheets in which the reinforcing fibers are in the form of a nonwoven mat with the fibers having a length in the range of from about 0.25 inches to a continuous strand, preferably in the range of from 1 inch to 100 inches or more. Prepreg sheets generally comprise in the range of from about 20 to about 70 percent by weight of reinforcing fiber. Where glass fibers are the reinforcing fibers the prepreg sheet will generally comprise in the range of from about 30 wt % to about 70 wt % glass fibers. The prepreg sheet can be formed by consolidating sheets of resin with the mat in a stamping or rolling operation under conditions of temperature and pressure to achieve good consolidation and fiber wetout.

A prime advantage of the method for forming the collar according to the invention lies in the ability to utilize the long fiber reinforcement in the manufacturing process. By long fiber reinforcement is meant that the reinforcing fibers have an average length of greater than 1 inch. Such fibers are not well suited for use in injection molding processes, for example, and impart greater strength to the final product. Where the reinforcing fibers are in the form of a nonwoven mat, materials handling is readily facilitated by prepreging the mat with the desired poly(arylene sulfide). The reinforcing fibers have higher freedom of movement in the molding process than fibers in woven form and the final product has greater strength than would be the case were it formed in an injection molding process utilizing short fiber reinforcement or in a stamp molding process utilizing woven material reinforcement because of the resulting poor fiber distribution.

In the method of the invention, there is provided a roll of deformable material in the form of at least one thermoplastic sheet containing long fiber reinforcement. The roll can be formed by heating the thermoplastic sheet in an infrared oven, for example, to the softening point of the polymer and then manually forming the roll using proper protective gear such as heavy gloves. The roll can be in the form of a continuous strip of prepreg sheet. However, it is often more advantageous to employ several shorter strips because a smaller oven can be used to heat the material to the softening point. In any event, the roll of softened material formed about a longitudinal axis is placed in an open mold cavity having a longitudinal axis so that the longitudinal axis of the roll is approximately coaxial with the longitudinal axis of the mold cavity. Where a vertical press is used, the softened roll can simply be dropped into the mold. A mold core is then inserted into the mold such as by lowering with a force sufficient to close the mold and deform the material to fill a mold cavity defined between the mold core and the mold when the mold is in the closed position. The mold cavity has a shape which determines the surfaces of a collar precursor having in common many of the surfaces in the finished collar. The precursor thus formed is then cooled, the mold is opened, and the collar precursor is removed from the mold. The end surfaces can then be machined on the collar precursor in a lathing operation.

In a preferred embodiment, the collar precursor has a cup shape with an end closure (cup bottom) which is removed from the precursor in the machining operation. The machining operation preferably includes a bevel cut to remove the end closure from the precursor and also to form one surface of the generally radially extending rib at one end of collar. The other surface of the rib can be defined during the molding operation by providing a bevel on the end of the mold core. It is advantageous that the mold cavity be shaped so as to provide a generally cylindrical inside surface on the collar precursor on the opposite end of the collar having the closure thereon. In this matter, positioning of the collar precursor on a lathe for the machining operation on the precursor is facilitated. By providing a mold cavity with a generally cylindrical outside surface adjacent to the end of the closure precursor having the collar thereon, positioning the collar precursor after machining a first end thereof to machine the second end is facilitated.

In another embodiment of the invention, there is provided a method for protecting a drill pipe string and a drill pipe casing from damage by the other during the drilling operation. Usually, the drill pipe string will be formed of sections of drill pipe which are positioned within the drill pipe casing with each section of the drill pipe having an upper end bearing internal threads and a lower end bearing external threads. This arrangement facilitates joining the pipe sections in conventional operations. At least one of the upper end and the lower end of the drill pipe section are beveled so that an annular groove is formed when two sections of drill pipe are joined together. Usually, both the upper and lower ends of each drill pipe are beveled to avoid the presence of sharp shoulders on the drill pipe string which could snag as the drill pipe is raised or lowered in the casing.

According to another embodiment of the invention, a collar is positioned on the upper end of the section of drill pipe. The collar has an upper end, a lower end, an outside surface and an inside surface. Preferably, the inside surface at the upper end of the collar has a generally radially inwardly extending flange for loose receipt by the annular groove formed by the joining of two drill pipe sections. The inside surface of the collar generally has a diameter sufficient to provide clearance between the inside of the collar and the outside of the drill pipe section and the outside of the collar is sized so as to provide adequate clearance between the outside of the collar and the inside of the drill pipe casing. The collar is characterized by a varying wall thickness which is dependent upon the circumferential position at which it is measured so as to resist spinning with the drill string in the drill casing. The lower end of the drill pipe section is then joined to the upper end of the drill pipe section having the collar positioned thereon and the pair of joined drill pipe sections is then lowered into the drill pipe casing. By forming the collar from a material which is softer than either the drill pipe string or the drill pipe casing each can be protected from the other where the material is more slippery with respect to the pipe than the casing and more slippery with respect to the casing than the pipe. It is preferred that the outside surface of the collar be of oval-shaped cross-section so as to resist spinning with the drill pipe string and the casing. It is further preferred to bevel the collar at both the upper end and lower end thereof to facilitate raising and lowering the drill pipe string within the drill pipe casing.

That which is claimed is:

1. A collar of generally tubular configuration and of varying wall thickness, said collar having a first end, a second end, a longitudinal axis extending between the first end and the second end, an inside surface, and an outside surface, the inside surface being characterized by a generally radially inwardly extending flange or rib at a position adjacent the first end of the collar and a generally cylindrical inside surface portion extending between the generally radially inwardly extending flange or rib and the second end of the collar, said generally cylindrical inside surface portion being concentrically positioned around the longitudinal axis of the collar, the outside surface of the collar being characterized by a portion of oval or elliptical cross-section, said portion of oval or elliptical cross-section having a major axis measured through the longitudinal axis of the collar and a minor axis measured through the longitudinal axis of the collar.

2. A collar as in claim 1 wherein the outside surface is further characterized by a bevel at the first end of the collar and a bevel at the second end of the collar and the outside portion of oval or eliptical cross-section is of oval cross-section.

3. A collar as in claim 2 wherein the outside surface of the collar is further characterized by a portion having a generally cylindrical configuration positioned between the bevel at the first end of the collar and the portion of the outside surface which has an oval cross section.

4. A collar as in claim 3 wherein the generally radially inwardly extending flange or rib is generally annularly shaped.

5. A collar as in claim 4 wherein the generally annularly shaped flange exhibits a V-shaped cross section.

6. A collar as in claim 5 comprising a glass fiber reinforcement in a continuous poly(arylene sulfide) matrix.

7. A collar as in claim 6 wherein the glass fibers generally have a length of over 1 inch.

8. A collar as in claim 7 comprising in the range of 30 wt % to 50 wt % glass fibers.

* * * * *